US007121691B2

(12) United States Patent
Coushaine et al.

(10) Patent No.: US 7,121,691 B2
(45) Date of Patent: Oct. 17, 2006

(54) LAMP ASSEMBLY WITH INTERCHANGEABLE LIGHT DISTRIBUTING CAP

(75) Inventors: Charles M Coushaine, Rindge, NH (US); Steve Sidwell, Hopkington, NH (US); Brad Ernest, Hooksett, NH (US); Thomas Tessnow, Weare, NH (US)

(73) Assignee: Osram Sylvania Inc., Danvers, MA (US)

( * ) Notice: Subject to any disclaimer, the term of this patent is extended or adjusted under 35 U.S.C. 154(b) by 51 days.

(21) Appl. No.: 10/946,113

(22) Filed: Sep. 22, 2004

(65) Prior Publication Data

US 2006/0061998 A1 Mar. 23, 2006

(51) Int. Cl.
*F21V 7/00* (2006.01)

(52) U.S. Cl. ..... 362/298; 362/346; 362/431

(58) Field of Classification Search ..... 362/345, 362/346, 296, 297, 298, 302, 304, 800, 259, 362/452, 431
See application file for complete search history.

(56) References Cited

U.S. PATENT DOCUMENTS

| | | | | |
|---|---|---|---|---|
| 1,050,466 | A * | 1/1913 | Jones | 362/303 |
| 4,050,775 | A * | 9/1977 | Scholten | 359/728 |
| 4,755,916 | A * | 7/1988 | Collins | 362/236 |
| 4,814,950 | A * | 3/1989 | Nakata | 362/539 |
| 5,278,731 | A * | 1/1994 | Davenport et al. | 362/551 |
| 5,491,619 | A * | 2/1996 | Gill | 362/294 |
| 5,894,195 | A | 4/1999 | McDermott | |
| 5,939,996 | A | 8/1999 | Kniveton et al. | |
| 6,271,622 | B1 | 8/2001 | Coushaine et al. | |
| 6,296,376 | B1 | 10/2001 | Kondo et al. | |
| 6,402,348 | B1 | 6/2002 | Ouellette et al. | |
| 6,488,392 | B1 | 12/2002 | Lu | |
| 6,558,032 | B1 * | 5/2003 | Kondo et al. | 362/516 |
| 6,637,921 | B1 | 10/2003 | Coushaine | |
| 6,641,293 | B1 * | 11/2003 | Kumar et al. | 362/539 |
| 6,758,582 | B1 | 7/2004 | Hsiao et al. | |
| 6,846,101 | B1 * | 1/2005 | Coushaine | 362/517 |
| 6,851,834 | B1 * | 2/2005 | Leysath | 362/303 |
| 2002/0008452 | A1 | 1/2002 | Coushaine et al. | |
| 2003/0063474 | A1 * | 4/2003 | Coushaine | 362/517 |
| 2003/0189828 | A1 | 10/2003 | Coushaine | |
| 2005/0162854 | A1 | 7/2005 | Finch | |

FOREIGN PATENT DOCUMENTS

| | | |
|---|---|---|
| EP | 1 126 209 A2 | 8/2001 |
| EP | 1 182 395 A2 | 2/2002 |

* cited by examiner

*Primary Examiner*—Renee Luebke
*Assistant Examiner*—Gunyoung T. Lee
(74) *Attorney, Agent, or Firm*—Young & Thompson

(57) ABSTRACT

A lamp assembly includes a thermally conductive post aligned in an axial direction, a light emitting diode (LED) at an axial end of the post, a first arched reflector that reflects light from the LED and that has an apex generally aligned along the axial direction and that is removably attached to the post, and a second reflector surrounding the post at a base of the post, where the second reflector reflects in the axial direction light that has been reflected from the first reflector.

19 Claims, 2 Drawing Sheets

LAMP ASSEMBLY WITH INTERCHANGEABLE LIGHT DISTRIBUTING CAP

BACKGROUND OF THE INVENTION

The present invention relates to a lamp assembly that includes a light source and light reflectors that direct light from the light source.

The lighting industry has sought to establish standard lamp assemblies that take advantage of properties of light emitting diodes (LEDs). However, individual LEDs have not produced enough light to be useful alone and some lamp assemblies have used multiple LEDs to form a useful light beam. The space required for multiple LEDs has tended to make these lamp assemblies application specific and generally not useful as standard lamp assemblies. LED lamp assemblies may use reflectors to spread the light and provide a beam of appropriate directivity.

Recent advances in LED technology have increased the light output of LEDs so that fewer LEDs, or only one LED, are needed to provide sufficient light for some applications. Since fewer LEDs are needed, the space for the LEDs in the lamp assembly is reduced, allowing for greater flexibility in lamp assembly design.

SUMMARY OF THE INVENTION

The present invention takes advantage of this increased flexibility and provides a novel lamp assembly with a light distributing cap that can be selectively attached to a post having one or more LEDs at an end thereof. The lamp manufacturer is thus able to use a "standard" light emitting assembly, which is usually the most costly part of the lamp assembly, and an array of low cost, interchangeable light distributing caps that each forms a particular light beam.

In one embodiment, the lamp assembly includes a post aligned in an axial direction, an LED at an axial end of the post that emits light in the axial direction, a first optic (the light distributing cap mentioned above) supported on the post and arching over the LED with an apex generally aligned along the axial direction, where the first optic reflects light from the LED, and a second optic around the post and spaced from the first optic, where the second optic reflects in the axial direction light that has been reflected from the first optic.

DESCRIPTION OF PREFERRED EMBODIMENTS

Figure 1:
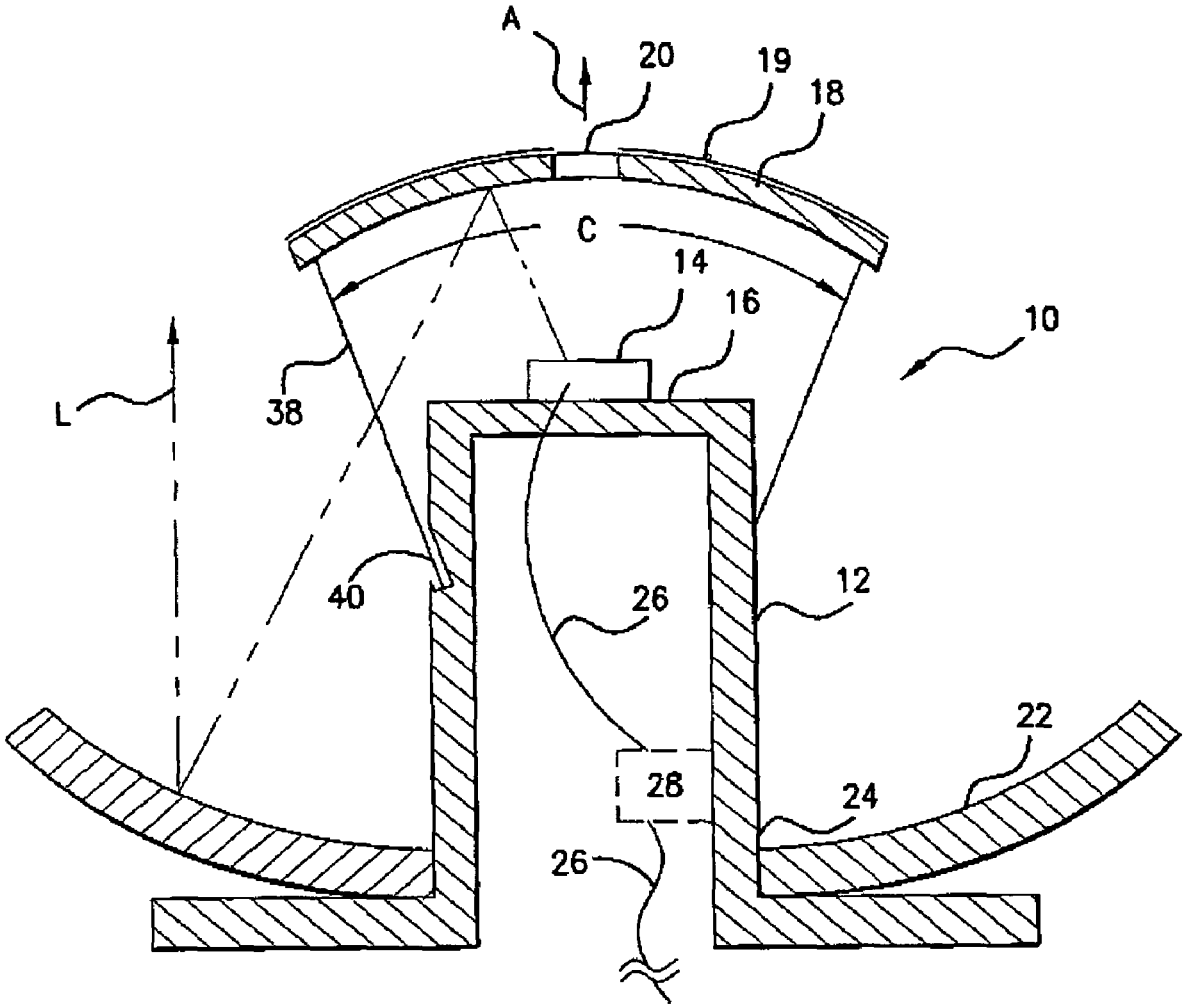
FIG. 1 is a cross section of an embodiment of the present invention.

With reference now to FIG. 1, a lamp assembly 10 of a preferred embodiment includes a thermally conductive post 12 longitudinally extended in an axial direction A, a light emitting diode (LED) 14 at an axial end 16 of the post 12, a first arched reflector 18 (a light distributing cap) that reflects light from the LED 14 and that has an apex 20 generally aligned along the axial direction A and that is attached to the post 12, and a second reflector 22 surrounding the post 12 at a base 24 of the post 12 and that reflects in the axial direction light that has been reflected from the first reflector 18.

In operation, light from the LED 14 is reflected from the first reflector 18 to the second reflector 22, which in turn reflects the light in a pattern commensurate with the optical design of the first and second reflectors. An exemplary light path is shown by dashed line L.

In one embodiment, the post 12, LED 14 and second reflector 22 constitute a "standard" light emitting part of the lamp assembly 10 that can be common for lamps of diverse applications, while the first reflector 18 is an interchangeable piece that can have optical properties appropriate for a particular application.

The post 12 may be thermally conductive, such as a suitable metal or other heat conducting material, to carry heat from the LED 14 to a heat sink (not shown). The post 12 could also include a heat sink, such as on the bottom of the post 12. The post 12 may have a suitable exterior shape, such as round or polygonal. The post 12 may be hollow and wiring 26 for the LED 14 and/or electrical components 28 for the lamp may be provided therein. Alternatively, the electrical components may be in a separate module carried beneath the lamp, as disclosed in U.S. Pat. No. 6,637,921 that is incorporated by reference.

The LED 14 (preferably only one) is mounted on the axial end 16 of the post 12. More than one LED may be used, bearing in mind that one of the advantages of the present invention is the relatively small area consumed by the LEDs at the axial end of the post.

The second reflector 22 is around the post 12 and spaced from the first reflector 18. The second reflector 22 may be a conventional parabolic reflector (or other suitable shape) adjacent or attached to the post opposite the axial end. The post 12 and the second reflector 22 may be mated conventionally and attached to a lamp coupling mechanism (e.g., bayonet coupling for an automobile lamp, wedge-type coupling, European flange type coupling, etc.) A technique for mating a reflector to a post and to lamp coupling mechanism is disclosed in U.S. Patent Application Publication 2003/0189828 that is also incorporated by reference.

The first reflector 18 arches over the LED 14 and its apex 20 is generally aligned with the axial direction A. The first reflector 18 may have a shape suitable for the intended purpose of the lamp and that is coordinated with the shape of the second reflector 22. That is, the first reflector 18 directs the light from the LED 14 to the second reflector 22 so that a light beam of suitable characteristics is provided from the second reflector 22. For example, one type of first reflector can direct light in a narrow forward beam and another type of first reflector can spread the light more broadly. Both types of reflectors may be used with the same "standard" post/LED unit.

The first reflector 18 may have a simple domed shape, multiple facets, or embody a complex optical prescription, as needed. Preferably, the first reflector extends like an umbrella over the LED, for a full 360° around the LED (in a horizontal plane). The sector of coverage C in a vertical plane depends on the optics of the first reflector and is typically from 90° to 180°. The first reflector may be clear or have a color so as to project a light of a particular color.

The first reflector 18 may be inherently reflective (or polished to be reflective) or coated with a reflective material 19, such as aluminum, on an interior or exterior surface. The first reflector 18 may be made of suitable material that is preferably low cost and easily adapted to the proper optical shape. For example, the first reflector may be glass, metal or plastic. In one embodiment, the first reflector 18 is Lexan™ or similar polycarbonate with a metallized reflective surface. Optionally, a portion of the first reflector at the apex 20 may be transparent (such as by not applying the reflective coating thereto) to avoid a dark spot in the beam by allowing light through the center "hole".

Figure 2:
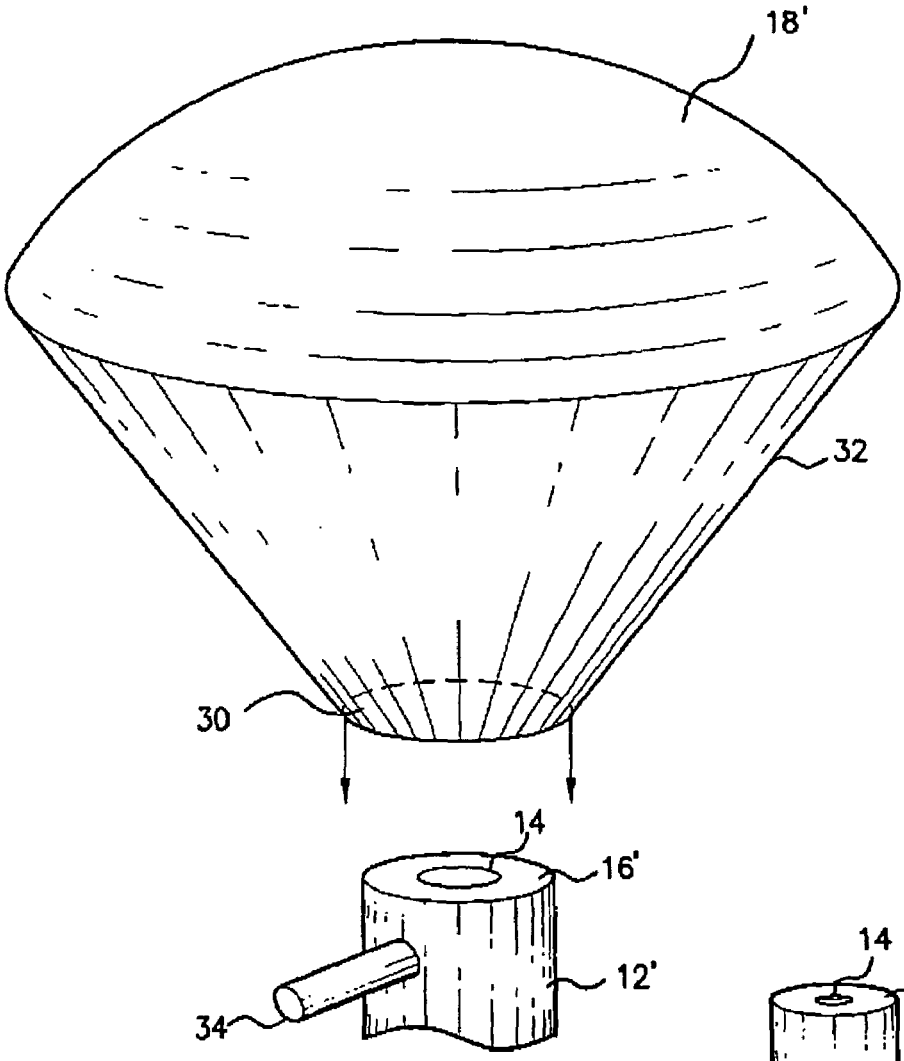
FIG. 2 is a pictorial representation of an embodiment of the light distributing cap of the present invention.

The first reflector 18 is carried by the post 12 and may be attached thereto in a manner that permits interchanging the first reflector. For example, the base of first reflector 18 may envelope the LED 14 in a cavity and latch to the post 12. In one embodiment shown in FIG. 2, the first reflector 18' includes a grommet 30 that mates with the axial end of the post 12' by sliding over the axial end as illustrated by the arrows in FIG. 2. The grommet 30 has a size and shape to facilitate placement on the axial end 16' of the post (e.g., the grommet having a shape corresponding to that of the axial end and slightly larger size). The grommet 30 may be attached to an arched reflector with one or more braces that can be opaque. Alternatively, the grommet 30 may be integral with the arched reflector where the sides 32 connecting the grommet 30 to the arched reflector 18' are the same material (transparent in this event) as the grommet and the arched reflector. The latter example may be considered a "bulb" with an open bottom that fits onto the axial end of the post, where the exterior of the arched top of the "bulb" is coated with a reflective coating so that light from the LED is directed to the second reflector.

Figure 3:
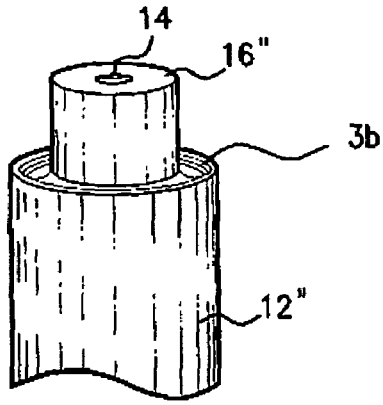
FIG. 3 is a partial pictorial representation showing a further embodiment of the post.

A side of the post may have a stop that defines a mating position of the grommet. The stop may be an extension 34 (FIG. 2) from the side of the post, a lip at the axial end, be annular groove 36 (FIG. 3) around the axial end 16" of the post 12", or other suitable arrangements for fixing a position of the grommet on the post.

In another embodiment, the first reflector 18 includes at least one brace 38 (FIG. 1) that mates with a corresponding brace holder 40 (such as a hole) in the post 12. The position of the braces and holders may be standard among all manner of first reflectors so that the first reflectors 18 may be interchanged.

In these methods for attaching the first reflector 18 to the post 12, the attachment (e.g., grommet or brace) may be permanently attached to the post or replaceably removable from the post such as with a snap-fit or similar arrangement.

In another embodiment, the first reflector is an optic (or lens) that includes an arched reflector spaced from the LED and connection means for attaching the first optic to the post. The connection means include the above-mentioned methods for attaching the first reflector and their equivalents.

While embodiments of the present invention have been described in the foregoing specification and drawings, it is to be understood that the present invention is defined by the following claims when read in light of the specification and drawings.

We claim:

1. A lamp assembly comprising a thermally conductive post longitudinally extended in an axial direction, a light emitting diode (LED) at an axial end of said post, a first arched reflector arranged to reflect light from said LED, said first arched reflector being removably attached to said post adjacent to said axial end and having an overall convex shape with respect tb said post, said convex shape having an apex generally aligned along the axial direction, and a second reflector surrounding said post at a base of said post, said second reflector being arranged to reflect in the axial direction light from said first reflector.

2. The lamp assembly of claim 1, wherein said first reflector comprises a grommet that mates with said axial end of said post.

3. The lamp assembly of claim 2, wherein a side of said post adjacent to said axial end has a circumferential stop that defines a mating position of said grommet.

4. The lamp assembly of claim 1, wherein said first reflector comprises at least one brace that mates with a corresponding brace holder in a side of said post adjacent to said axial end.

5. The lamp assembly of claim 1, wherein said apex of said first reflector is transparent.

6. The lamp assembly of claim 1, with only one said LED.

7. A lamp assembly comprising:

a longitudinally extended post aligned in an axial direction;

an LED at an axial end of said post and emitting light in the axial direction;

a first optic removably attached to said post adjacent to said axial end, said first optic arching over said LED with an overall convex shape with respect to said post, said convex shape having an apex generally aligned along the axial direction, said first optic being light reflective and reflecting light from said LED; and a second optic around said post and spaced from said first optic, said second optic being light reflective and reflecting in the axial direction light that has been reflected from said first optic.

8. The lamp assembly of claim 7, wherein said first optic comprises an arched reflector attached to a grommet that is radially inward from said reflector, said grommet mating with said axial end of said post.

9. The lamp assembly of claim 8, wherein a side of said post adjacent to said axial end has a stop that defines a mating position of said grommet.

10. The lamp assembly of claim 8, wherein an interior size of said grommet is larger than an exterior size of said axial end so that said grommet is removable from said axial end.

11. The lamp assembly of claim 7, wherein said first optic comprises an arched reflector attached to one or more braces that mate with corresponding brace holders in said post.

12. The lamp assembly of claim 7, wherein said post is thermally conductive.

13. The lamp assembly of claim 7, wherein said first optic comprises a reflective coating.

14. The lamp assembly of claim 7, wherein said apex of said first optic is transparent.

15. The lamp assembly of claim 7, wherein said post is hollow.

16. The lamp assembly of claim 7, with only one said LED.

17. A lamp assembly comprising:

a thermally conductive and longitudinally extended post aligned in an axial direction;

an LED at an axial end of said post and emitting light in the axial direction;

a first optic comprising an arched reflector spaced from said LED and having an overall convex shape with respect to said post, said convex shape having an apex generally aligned along the axial direction, and connection means for removably attaching said first optic to said post adjacent to said axial end, said first optic being light reflective and reflecting light from said LED; and a second optic surrounding said post and spaced from said first optic, said second optic being light reflective and reflecting in the axial direction light that has been reflected from said first optic.

18. The lamp assembly of claim 17, wherein said connection means comprises a grommet that is radially inward from said reflector, said grommet mating with said axial end of said post.

19. The lamp assembly of claim 17, wherein said connection means comprises at least one brace that mates with corresponding brace holders in said post.

* * * * *